US005524800A

United States Patent [19]

Arney

[11] Patent Number: 5,524,800

[45] Date of Patent: Jun. 11, 1996

[54] REPLACEMENT DRAWSTRING FOR GARMENT WAISTBANDS AND HOODS, LAUNDRY BAGS AND THE LIKE

[76] Inventor: David S. Arney, 28421 Center Ridge Rd. A-11, Westlake, Ohio 44145

[21] Appl. No.: 259,618

[22] Filed: Jun. 14, 1994

[51] Int. Cl.[6] ..... A41H 43/00

[52] U.S. Cl. ..... 223/50; 2/243.1; 2/236; 223/103

[58] Field of Search ..... 223/50, 102, 103, 223/104, 105; 2/236, 237, 311, 338, 312, 235

[56] References Cited

U.S. PATENT DOCUMENTS

| | | | |
|---|---|---|---|
| 609,712 | 8/1898 | Thompson | 223/103 |
| 2,491,776 | 12/1949 | Skelton | 223/105 |
| 3,097,474 | 7/1963 | Rohdenburg | 223/102 |
| 3,926,194 | 12/1975 | Greenberg et al. | 223/102 |
| 3,949,756 | 4/1976 | Ace | 223/102 |
| 4,671,437 | 6/1987 | Sauger | 223/50 |
| 4,773,343 | 9/1988 | Riche | 223/102 |
| 5,353,972 | 10/1994 | Mandel | 223/50 |

FOREIGN PATENT DOCUMENTS

| | | | |
|---|---|---|---|
| 171314 | 5/1952 | Germany | 223/105 |

*Primary Examiner*—C. D. Crowder
*Assistant Examiner*—Larry D. Worrell, Jr.
*Attorney, Agent, or Firm*—Donald A. Bergquist

[57] ABSTRACT

A replacement drawstring for use in garments or drawstring bags and designed to easily be threaded through the drawstring tunnel around the opening of said garment or bag. Breakably molded as a part of an aglet at one end of the drawstring is an elongated wand or bodkin to simplify threading. After threading, the wand is broken off and may be discarded.

3 Claims, 1 Drawing Sheet

REPLACEMENT DRAWSTRING FOR GARMENT WAISTBANDS AND HOODS, LAUNDRY BAGS AND THE LIKE

FIELD OF THE INVENTION

This invention relates to a replacement drawstring for garment waistbands and hoods, laundry bags and the like.

DESCRIPTION OF THE PRIOR ART

When typical such drawstrings break or slip out of their tunnel, it is difficult to re-string them because their aglet cannot be easily manipulated through the tunnel. Prior art reveals many devices which may be attached in some manner to a drawstring, but the art does not appear to show such a facilitating device built or molded into a drawstring.

SUMMARY OF THE INVENTION

This invention, however, reveals an aftermarket or replacement drawstring believed to be entirely new in the art, a drawstring, marketable in various lengths, with a discardable re-stringing wand or bayonet breakably molded to the end of one aglet of the drawstring.

DESCRIPTION OF THE PREFERRED EMBODIMENT

Figure 1:
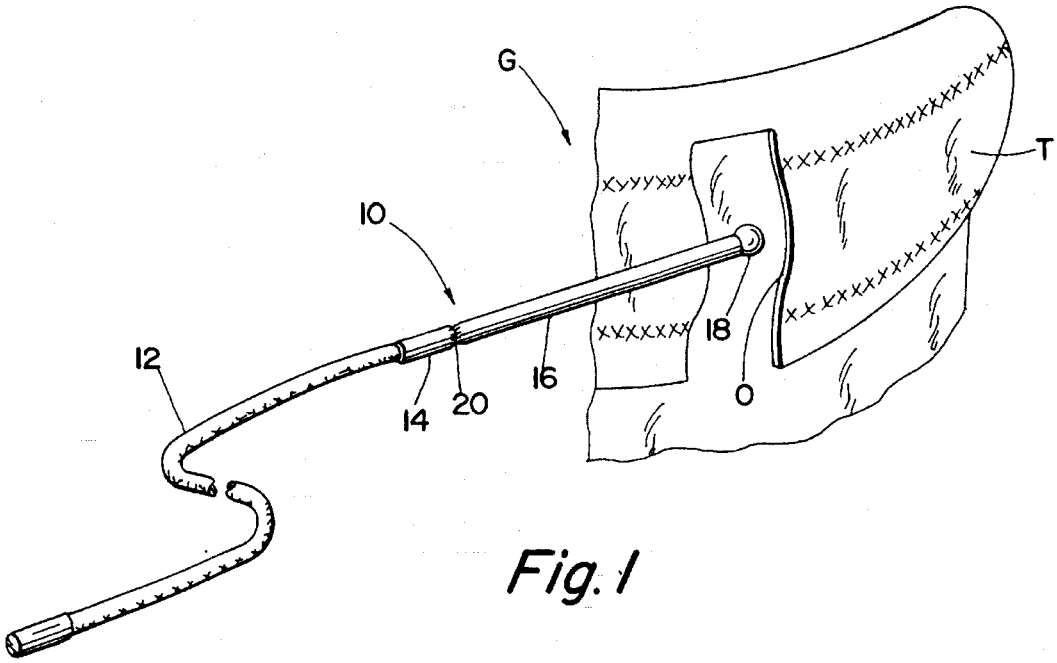
FIG. 1 is a perspective view of the invention in the environment in which it is used.

In FIG. 1, G is a garment or laundry bag with a drawstring tunnel T that has an opening 0. The device of the invention 10 consists of a drawstring 12 which, at one end, has attached an aglet 14 molded to a wand or bayonet 16 having a ball 18 at its leading end. The wand may be snapped off at parting line 20.

Figure 2:
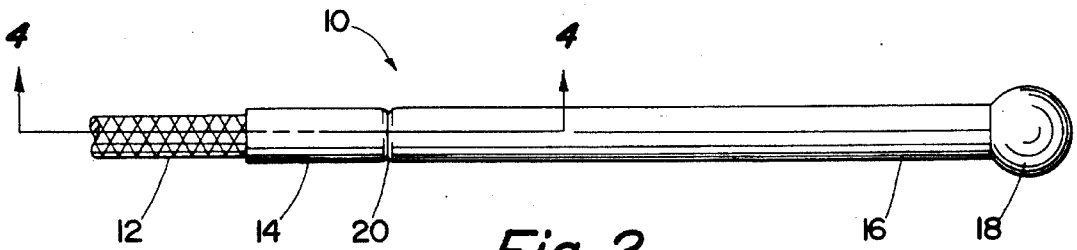
FIG. 2 is an enlarged side elevation of the invention.
Figure 3:
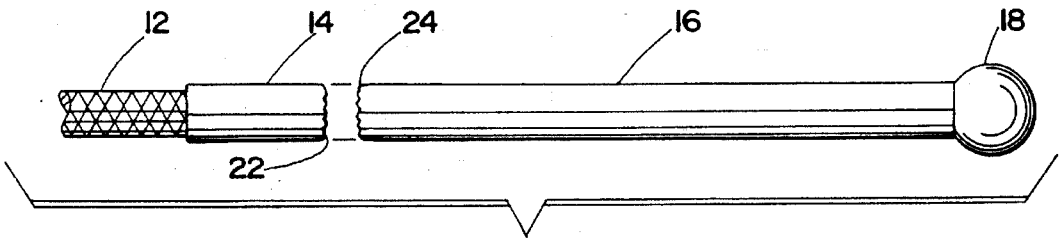
FIG. 3 is an enlarged side elevation depicting the wand or bayonet literally broken away from the aglet after re-stringing.

FIG. 2 depicts the wand or bayonet 16 of the replaceable drawstring 10 before it has been snapped off at parting line 20, while FIG. 3 depicts the same drawstring after the snap has occurred, thus revealing the broken end 22 of the aglet 14 and the broken end 24 of the wand or bayonet 16.

Figure 4:
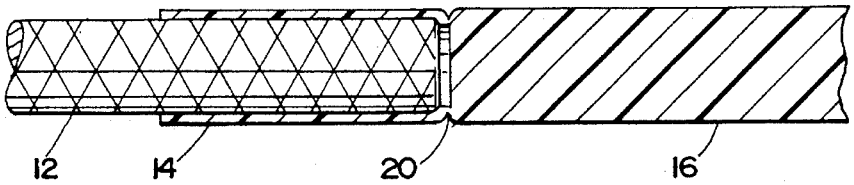
FIG. 4 is an enlarged fragmentary cross-section taken on line 4—4 of FIG. 2.

The FIG. 4 cross-section clearly reveals that the break may be cleanly made because it occurs only at the outer periphery of reduced wall thickness along the parting line 20.

In practice, the replaceable drawstring 10 is introduced into the opening 0 of the garment or laundry bag tunnel T, and is then threaded in normal fashion through the full length of the tunnel facilitated by ball 18 at its leading end. When the drawstring 10 emerges from the tunnel T, the wand or bayonet 16 is snapped by hand and may be discarded, thus leaving behind a standard drawstring with standard aglets at either end.

I claim:

1. A replacement drawstring having at one end an aglet molded in one piece to a wand with circumferential notch forming a junction between said aglet and said wand to facilitate separating the aglet and the wand by breaking at said junction after use, wherein before said separating, said wand is useful to facilitate threading of said drawstring through a drawstring tunnel.

2. The drawstring of claim 1, further comprising a rounded leading end of said wand, thereby to smooth threading through said tunnel.

3. The drawstring of claim 1 wherein said aglet molded in one piece to a wand is molded from a substantially rigid polymer.

* * * * *